US008931200B2

(12) United States Patent
Pratt

(10) Patent No.: US 8,931,200 B2
(45) Date of Patent: Jan. 13, 2015

(54) SLIDE-LOCK ENGAGEMENT DEVICE

(76) Inventor: Nathan Pratt, Oklahoma City, OK (US)

( * ) Notice: Subject to any disclaimer, the term of this patent is extended or adjusted under 35 U.S.C. 154(b) by 0 days.

(21) Appl. No.: 13/365,233

(22) Filed: Feb. 2, 2012

(65) Prior Publication Data

US 2012/0192474 A1 Aug. 2, 2012

Related U.S. Application Data

(60) Provisional application No. 61/438,829, filed on Feb. 2, 2011.

(51) Int. Cl.

| | |
|---|---|
| ***F41A 35/00*** | (2006.01) |
| ***F41A 11/00*** | (2006.01) |
| ***F41A 17/42*** | (2006.01) |
| ***F41A 29/00*** | (2006.01) |

(52) U.S. Cl.

CPC ..... *F41A 11/00* (2013.01); *F41A 17/42* (2013.01); *F41A 29/00* (2013.01); *F41A 35/00* (2013.01)

USPC ..... 42/90

(58) Field of Classification Search

USPC ..... 42/70.11, 70.06, 70.07, 108, 90, 106; 89/1.4, 1.42; D8/313, 325, 328, 394; 403/227; 24/455, 531, 532, 545, 546, 24/556; 294/99.2

See application file for complete search history.

(56) References Cited

U.S. PATENT DOCUMENTS

| | | | | | |
|---|---|---|---|---|---|
| 390,260 | A | * | 10/1888 | Seewald | 294/99.2 |
| 1,470,280 | A | * | 10/1923 | McCulloch | 24/540 |
| 3,349,771 | A | * | 10/1967 | Baer | 606/157 |
| D224,406 | S | * | 7/1972 | Heck | D13/120 |
| D229,392 | S | * | 11/1973 | Faust | D8/394 |
| D284,920 | S | * | 8/1986 | Van Horn | D6/491 |
| 6,920,713 | B1 | * | 7/2005 | Love | 42/94 |
| D522,834 | S | * | 6/2006 | Lalancette et al. | D8/72 |
| D590,443 | S | * | 4/2009 | Goldman et al. | D19/65 |
| 2002/0124361 | A1 | * | 9/2002 | Tamura | 24/546 |
| 2005/0001439 | A1 | * | 1/2005 | Lukaszynski et al. | 294/99.2 |
| 2009/0173035 | A1 | * | 7/2009 | Collins | 52/702 |
| 2009/0293242 | A1 | * | 12/2009 | Bithell et al. | 24/458 |

* cited by examiner

*Primary Examiner* — Samir Abdosh
*Assistant Examiner* — John D Cooper
(74) *Attorney, Agent, or Firm* — Martin S. High, P.C.

(57) ABSTRACT

A device for selectively engaging and depressing the slide lock of a firearm includes a pair of engagement tabs that may be utilized in the field stripping of a firearm. In particular, the tabs have slots that are configured to accept the slide lock of the firearm, and facilitate disengagement of the lock to the slide assembly of the firearm.

7 Claims, 3 Drawing Sheets

SLIDE-LOCK ENGAGEMENT DEVICE

CLAIM OF BENEFIT OF PRIOR-FILED PROVISIONAL APPLICATION

This application claims the benefit of U.S. Provisional Application Ser. No. 61/438,829 filed on Feb. 2, 2011.

FIELD OF THE INVENTION

The present invention is generally related to the field of firearms.

BACKGROUND OF THE INVENTION

Certain handguns have a removable "slide." Removing the slide enables the user to disassemble the gun and clean it, among other things. The process of removing the slide is often referred to as "field stripping" the gun. In order to remove the slide, the user must pull down on a slide lock lever. Many users grasp the slide lock lever with their fingertips or fingernails and often struggle to engage and pull down on the slide lock lever. Therefore there is a need for a device that enables the user to easily pull down on the slide lock lever of a gun without struggle.

SUMMARY OF THE INVENTION

In a presently preferred embodiment, the present invention includes a device for selectively engaging and depressing the slide lock of a fire arm. The device includes a pair of engagement tabs that may be utilized in the field stripping of a firearm. In particular, the tabs have slots that are configured to accept the slide lock of the firearm, and facilitate disengagement of the lock to the slide assembly of the firearm.

DETAILED DESCRIPTION OF PREFERRED EMBODIMENTS

Figure 1:
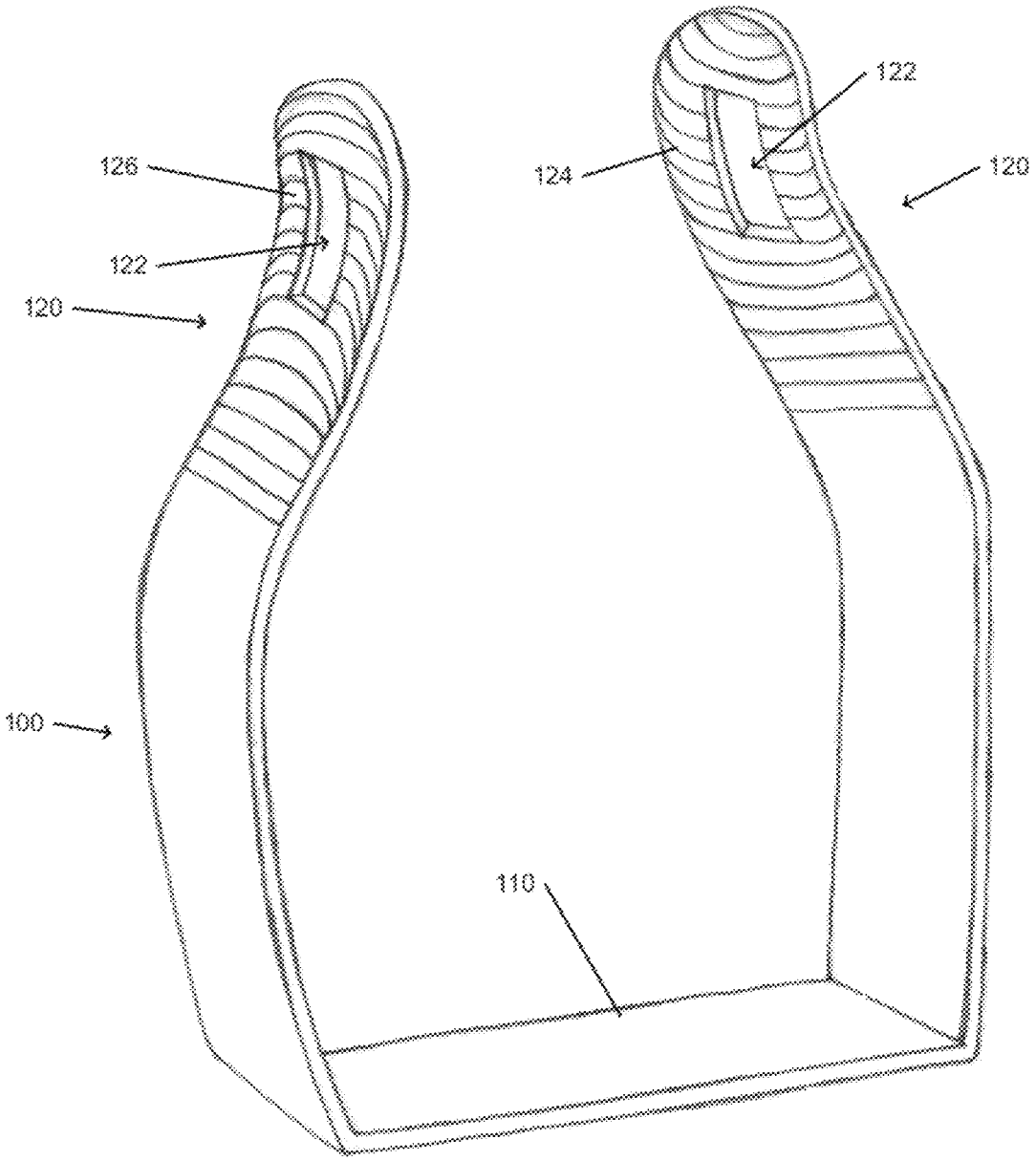
FIG. 1 is a side perspective view of the slide-lock engagement device.

Referring first to FIG. 1, depicted therein is a slide-lock engagement device 100. The slide-lock engagement device 100 includes a u-bar 110 and a pair of engagement tabs 120. Each engagement tab 120 includes a slide lock receiving slot 122, a firearm engagement side 124 and a user engagement side 126. In a second embodiment, each engagement tab 120 additionally includes a beveled edge 128. The slide-lock engagement device 100 is preferably constructed from a durable material that exhibits some spring-force resistance to a compressive load. In a preferred embodiment, the slide-lock engagement device 100 is manufactured from metal or plastic. Optionally, all or portions of the slide-lock engagement device 100 are coated in a material that improves grip and reduces metal-to-metal contact. Suitable coatings include paint, rubber, latex, polymers, plastics or elastomers.

Figure 3:
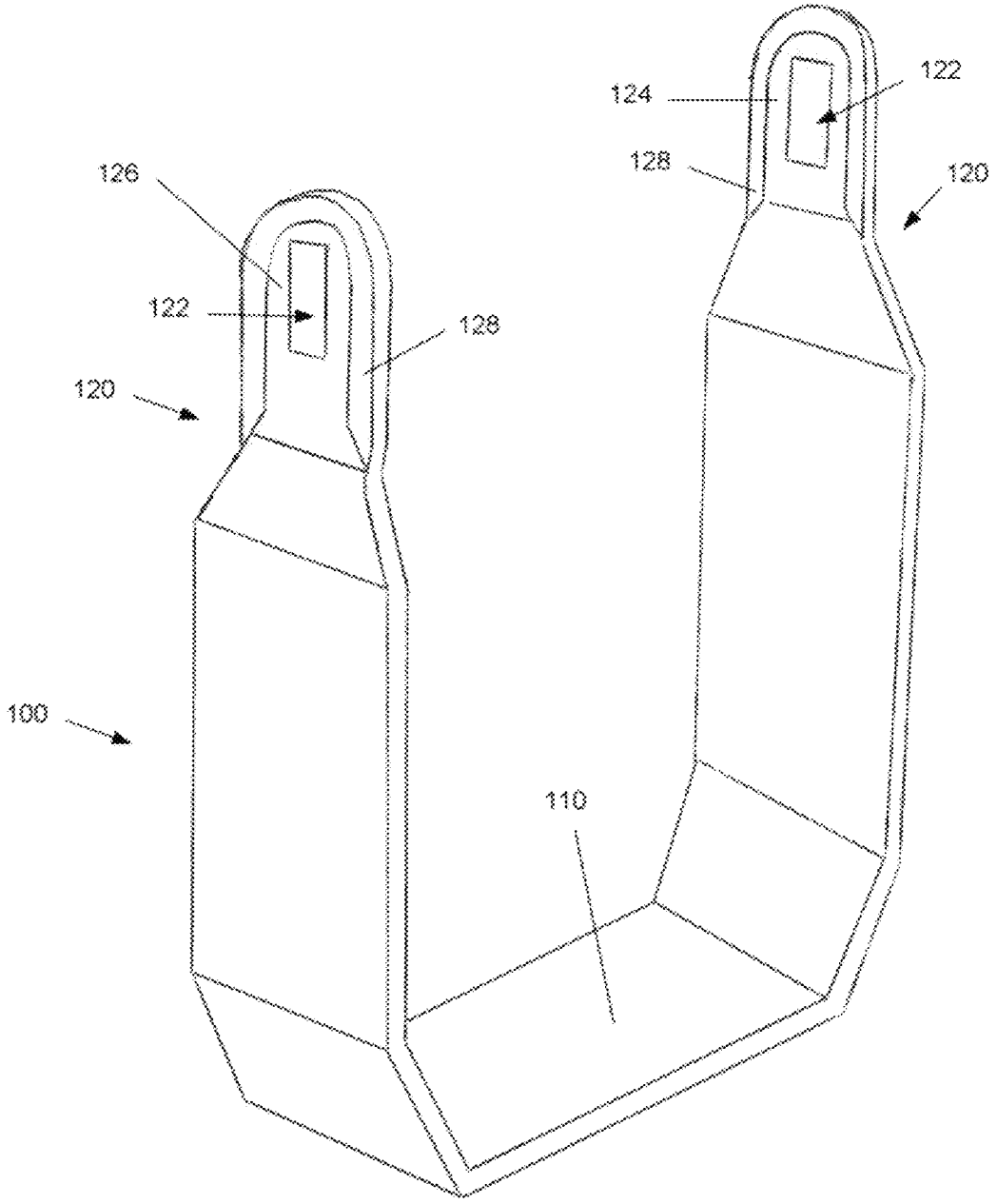
FIG. 3 is side perspective view of a second embodiment of the slide-lock engagement device.

The u-bar 110 is connected to each of the engagement tabs 120, and is configured to be semi-flexible so that the engagement tabs 120 can be selectively compressed and decompressed. The slide-lock receiving slot 122 of each engagement tab 120 is typically positioned in the center of the engagement tab 120, but it will be understood other positions of the slide-lock receiving slot 122 within the engagement tab 120 are possible. As shown in FIG. 1, the firearm engagement side 124 and the user engagement side 126 can be textured to provide a better grip when in use. Additionally, the engagement tab 120 can be beveled as depicted in FIG. 3, which depicts a second embodiment that includes a beveled edge 128. The beveled edge 128 facilitates a more comfortable grip for the user. It will be understood that the beveled edge 128 can be utilized with both engagement sides 124, 126 that are textured and engagement sides 124, 126 that are not textured. Likewise, the u-bar 110 could be textured to enhance the user's grasp of the slide-lock engagement device 100.

Figure 2:
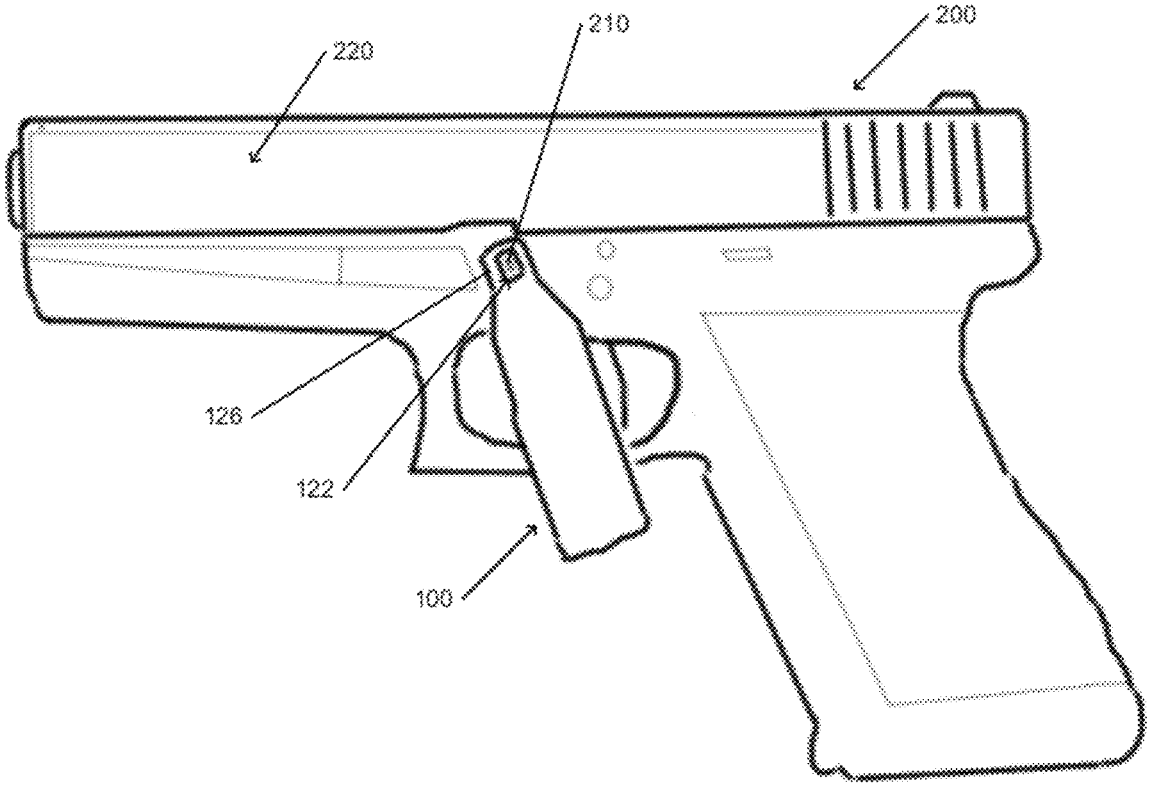
FIG. 2 is a side-view of the slide-lock engagement device when engaged with a firearm.

Turning to FIG. 2, depicted therein is a firearm 200, upon which the slide-lock engagement device 100 could be used. As shown in FIG. 2, the firearm 200 is depicted fully assembled. The firearm 200 includes a slide assembly 220 which must be removed in order to "field strip" the firearm 200. Separation of the slide assembly 220 from the rest of the firearm 200 requires the user to grip a slide-lock 210 and force it downward until the slide assembly locking mechanism (not shown) permits removal of the slide assembly 220. Because the slide-lock 210 rarely extends very far from the firearm 200, users often have trouble generating enough force to move the slide-lock 210 sufficiently downward to unlock the slide assembly 220 without losing their grip on the slide-lock 210.

To solve this problem, a user may utilize the slide-lock engagement device 100 to obtain a sufficient grip on the slide-lock 210. The user begins by positioning the slide-lock engagement device 100 under the firearm 200, and then moving the slide-lock engagement device 100 upwards until the u-bar 110 straddles the firearm 200 while the slide-lock receiving slots 122 are positioned over both edges of the slide-lock 210. The user then compresses the user-engagement sides 126 of the slide-lock engagement tabs 120 until the firearm engagement sides 124 of the slide-lock engagement tabs 120 come into contact with the firearm 200 and the edges of the slide-lock 210 are received by the slide-lock receiving slots 122.

While maintaining compression, the user grips the slide-lock engagement device 100 via its user-engagement sides 126, and then applies a sufficient downward force to manipulate the slide-lock 210 into a position where the slide assembly locking mechanism (not shown) permits removal of the slide assembly 220. It will be understood that once the slide assembly 220 is removed from the firearm 200, the remainder of the field-stripping process may continue as per normal procedures for the particular type of firearm 200.

It will be noted that in the preferred embodiment the engagement tabs 120 are curved slightly so that only a portion of the firearm engagement side 124 engages the firearm 200. When configured in this manner, the risk of accidentally scratching the firearm 200 with the slide-lock engagement device 100 is reduced. In addition, the user is provided with additional comfort and grip as the curve of the engagement tab 120 is such that the user engagement side 126 is configured to curve in a concave manner to match the curvature of the user's fingertips. In alternative embodiments, the slide-lock engagement tabs 120 may likewise be shaped to reduce the risks of accidental scratching for each particular type of firearm 200. For example, in the second embodiment depicted in FIG. 3, the engagement tabs 120 are beveled as opposed to curved and thereby include a beveled edge 128. Furthermore, it will be understood that the slide lock engagement tabs 120 may be sized and shaped to fit different types and sizes of guns. For certain applications, it may be important to provide the slide lock engagement tabs 120 with additional curvature so that portions of the firearm do not interfere with the function of the slide-lock engagement device 100.

It will be understood that while FIG. 2 depicts a preferred embodiment of the slide-lock engagement device 100, other alternative embodiments are possible. For example, the second embodiment depicted in FIG. 3 includes a u-bar 110 that is slightly curved relative to the u-bar 110 depicted in FIG. 1. Indeed the particular shape of the u-bar 110 may be configured to fit different shapes and sizes of guns. It will be noted that in FIG. 3, that the u-bar is relatively wider than the engagement tabs 120, facilitating an easier grasp by the users. Likewise, the engagement tabs 120 depicted in FIG. 3 are narrower than the u-bar 110 so that they may more easily match the contours of the firearm 200.

Moreover, the slide-lock engagement device 100 can be configured such that the user can engage the slide-lock 210 by pressing downward from the top of the firearm 200 as opposed to being pulled downward in the preferred embodiment. In addition, when not in use, the slide-lock engagement device 100 could be modified to serve as a simple key-ring by positioning a wire or bar between the slide-lock receiving slots 122.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms expressed herein.

I claim:

1. A slide-lock engagement device comprising:

a pair of engagement tabs, each engagement tab having a receiving slot configured to accept the slide-lock of a firearm; and a u-bar, wherein the u-bar is positioned between each of the pair of engagement tabs, wherein each of the pair of engagement tabs comprise a beveled edge on the firearm engagement side so that the firearm engagement side engages the slide-lock of the firearm;

wherein the beveled edge on the firearm engagement side allows the slide-lock receiving slots to contact the edges of the slide-lock of the firearm;

wherein the engagement tabs are narrower than the u-bar so that they match the contours of the firearm;

wherein the slide lock engagement tabs are sized and shaped to fit the contours of the firearm so that portions of the firearm do not interfere with the function of the slide lock device;

wherein the slide lock receiving slot and the firearm engagement side are in the same plane (shown in FIG. 3);

wherein the edge of the slide lock receiving slot that engages the slide lock is on the same plane as the firearm engagement side; and wherein the slide-lock engagement device is constructed from a durable material that exhibits some spring-force resistance to a compressive load so that when receiving slots are positioned over both edges of the slide-lock the engagement tabs are compressed so that the engagement tabs come into contact with the firearm and the edges of the firearm slide-lock are received by the slide-lock receiving slots.

2. The slide-lock engagement device of claim 1, wherein each of the pair of engagement tabs further comprises a firearm engagement side and a user engagement side.

3. The slide-lock engagement device of claim 2, wherein the u-bar is textured.

4. The slide-lock engagement device of claim 2, wherein the user engagement side is textured.

5. The slide-lock engagement device of claim 2, wherein the u-bar is textured and the user engagement side is textured.

6. The slide-lock engagement device of claim 5, wherein each of the pair of engagement tabs are beveled.

7. The slide-lock engagement device of claim 5, wherein each of the pair of engagement tabs are curved.

* * * * *